US005720349A

United States Patent [19]

Pleasants et al.

[11] Patent Number: 5,720,349

[45] Date of Patent: Feb. 24, 1998

[54] STARTING MILL AND OPERATIONS

[75] Inventors: Charles W. Pleasants, Cypress; Thurman B. Carter, Houston, both of Tex.

[73] Assignee: Weatherford U.S., Inc., Houston, Tex.

[21] Appl. No.: 542,439

[22] Filed: Oct. 12, 1995

[51] Int. Cl.[6] ..... E21B 7/08; E21B 29/00

[52] U.S. Cl. ..... 166/298; 166/55.7

[58] Field of Search ..... 166/298, 55.7, 166/55.1

[56] References Cited

U.S. PATENT DOCUMENTS

| | | | |
|---|---|---|---|
| 1,570,518 | 1/1926 | Mitchell | 166/117.5 |
| 2,807,440 | 9/1957 | Beck | 255/1.6 |
| 2,885,182 | 5/1959 | Hering | 255/1.6 |
| 3,095,039 | 6/1963 | Kinzback | 166/117.6 |
| 3,908,759 | 9/1975 | Cagle et al. | 166/117.6 |
| 4,182,423 | 1/1980 | Ziebarth et al. | 175/61 |
| 4,324,299 | 4/1982 | Nagel | 175/107 |
| 4,415,205 | 11/1983 | Rehm et al. | 299/5 |
| 4,796,709 | 1/1989 | Lynde et al. | 166/55.6 |
| 4,807,704 | 2/1989 | Hsu et al. | 166/313 |
| 4,887,668 | 12/1989 | Lynde et al. | 166/55.8 |
| 4,938,291 | 7/1990 | Lynde et al. | 166/55.8 |
| 4,978,260 | 12/1990 | Lynde et al. | 166/55.6 |
| 4,984,488 | 1/1991 | Lunde et al. | 166/55.6 |
| 5,014,778 | 5/1991 | Lynde et al. | 166/55.6 |
| 5,038,859 | 8/1991 | Lynde et al. | 166/55.6 |
| 5,058,666 | 10/1991 | Lynde et al. | 166/55.6 |
| 5,086,838 | 2/1992 | Cassel et al. | 166/55.6 |
| 5,150,755 | 9/1992 | Cassel et al. | 166/297 |
| 5,199,513 | 4/1993 | Stewart et al. | 175/73 |
| 5,297,630 | 3/1994 | Lynde et al. | 166/297 |
| 5,373,900 | 12/1994 | Lynde et al. | 166/297 |
| 5,379,845 | 1/1995 | Blount et al. | 166/382 |
| 5,392,862 | 2/1995 | Swearingen | 166/386 |
| 5,425,417 | 6/1995 | Carter et al. | 166/117.6 |
| 5,425,419 | 6/1995 | Sieber | 166/206 |
| 5,429,187 | 7/1995 | Beargrie et al. | 166/55.1 |
| 5,431,220 | 7/1995 | Lennon et al. | 166/55.7 |
| 5,443,129 | 8/1995 | Bailey et al. | 175/45 |
| 5,445,222 | 8/1995 | Pritchard et al. | 116/298 |
| 5,452,759 | 9/1995 | Carter et al. | 166/117.6 |
| 5,456,312 | 10/1995 | Lynde et al. | 166/55.6 |
| 5,522,461 | 6/1996 | Carter et al. | 166/55.7 X |
| 5,551,509 | 9/1996 | Braddick | 166/55.7 |

FOREIGN PATENT DOCUMENTS 2227038 10/1989 United Kingdom .

OTHER PUBLICATIONS

PCT/GB96/02510 Int'l Search Report & Invitation To Pay Additional Fees (foreign counterpart to this case 08/542,439).

"Catalog 1958–59," Kinzbach Tool Co., Inc., pp. 6,7,8; 1958.

"1990–91 General Catalog," A–1 Bit & Tool Co., p. 9, 1990.

"TIW's SS–WS Whipstock Pakcer," Texas Iron Works, p. 111.9.18; 1986.

"Weatherford Fishing & Rental Tool Services," Weatherford, Inc., 1993.

"Improved Casing Sidetrack Procedure Now Cuts Wider, Longer Windows," Cagle et al, Petroleum Engineer Int'l, Mar., 1979.

*Primary Examiner*—William P. Neuder

*Attorney, Agent, or Firm*—Guy McClung

[57] ABSTRACT

A new mill has been invented which has a body, a fluid flow bore therethrough, and apparatus therein for selectively controlling the flow of fluid through the bore. In one aspect the mill is a starting mill connected to a whipstock and controlled flow of fluid through the mill results in setting of an anchor device or anchor packer below the whipstock. In one aspect the mill is initially filled with fluid and apparatus is provided in the mill to permit controlled fluid leakage from within the mill. In another aspect the mill has apparatus thereon for isolating a shear stud from a downward force imposed on the mill, the shear stud releasably connecting the mill to a whipstock.

19 Claims, 9 Drawing Sheets

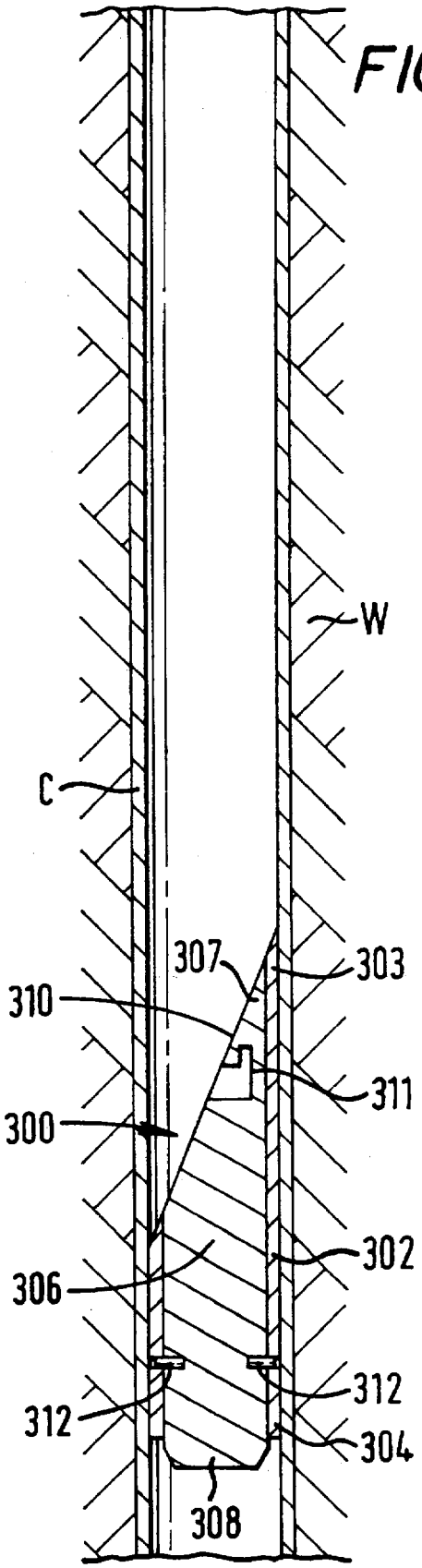
FIG.15A
FIG.15B
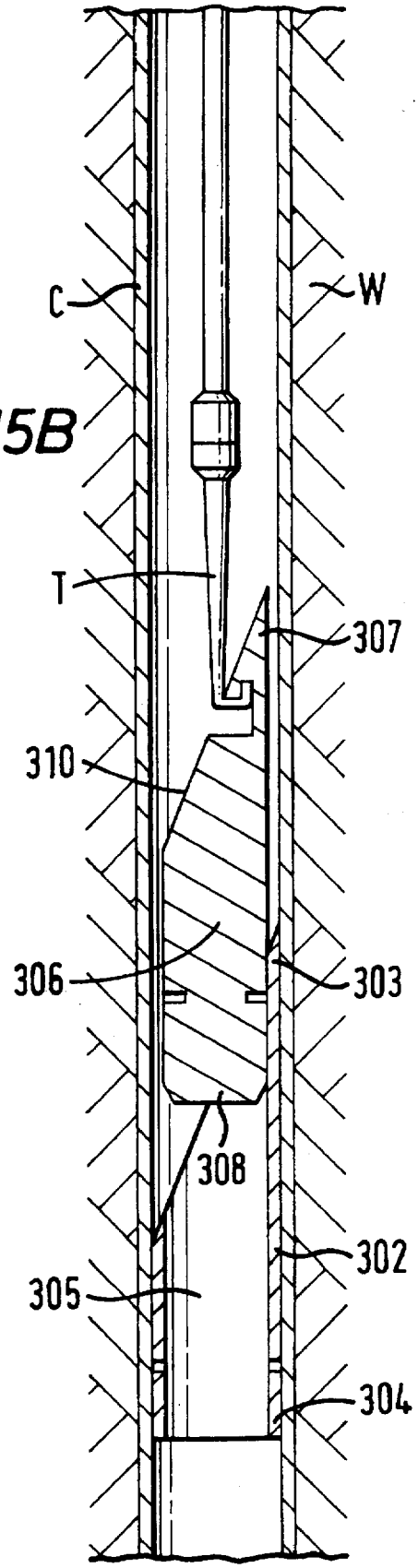

STARTING MILL AND OPERATIONS

BACKGROUND OF THE INVENTION

1. Field of the Invention

This invention is related to milling processes, milling tools and whipstocks; and in one aspect to a starting mill and milling processes which use it.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge adjacent or beneath the cutting blades. An upward flow of the discharged fluid in the annulus outside the tool removes cuttings or chips from the well resulting from the milling operation.

Milling tools have been used for removing a section of existing casing from a well bore to permit a sidetracking operation in directional drilling and to provide a perforated production zone at a desired level. Also, milling tools are used for milling or reaming collapsed casing and for removing burrs or other imperfections from windows in the casing system.

Prior art sidetracking methods use cutting tools of the type having cutting blades. A deflector such as a whipstock causes the tool to be moved laterally while it is being moved downwardly in the well during rotation of the tool to cut an elongated opening pocket, or window in the well casing.

Certain prior art well sidetracking operations which employ a whipstock also employ a variety of different milling tools used in a certain sequence. This sequence of operation may require a plurality of "trips" into the wellbore. For example, in certain multi-trip operations, an anchor, slip mechanism, or an anchor-packer is set in a wellbore at a desired location. This device acts as an anchor against which tools above it may be urged to activate different tool functions. The device typically has a key or other orientation indicating member. The device's orientation is checked by running a tool such as a gyroscope indicator or measuring-while-drilling device into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is releasably secured at the top of the whipstock, e.g. with a shearable setting stud and nut connected to a pilot lug on the whipstock. The tool is then lowered into the wellbore so that the anchor device or packer engages the stinger and the tool is oriented. Slips extend from the stinger and engage the side of the wellbore to prevent movement of the tool in the wellbore; and locking apparatus locks the stinger in a packer when a packer is used. Pulling on the tool then shears the setting stud, freeing the starting mill from the tool. Certain whipstocks are also thereby freed so that an upper concave portion thereof pivots and moves to rest against a tubular or an interior surface of a wellbore. Rotation of the string with the starting mill rotates the mill. The starting mill has a tapered portion which is slowly lowered to contact a pilot lug on the concave face of the whipstock. This forces the starting mill into the casing and the casing is milled as the pilot lug is milled off. The starting mill moves downwardly while contacting the concave portion and cuts an initial window in the casing. The starting mill is then removed from the wellbore. A window mill, e.g. on a flexible joint of drill pipe, is lowered into the wellbore and rotated to mill down from the initial window formed by the starting mill. A watermelon mill may be used behind the window mill for rigidity; and to lengthen the casing window if desired. Typically then a window mill with a watermelon mill mills all the way down the concave face of the whipstock forming a desired cut-out window in the casing. Then, the window mill is removed and, as a final option, a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore.

There has long been a need for efficient and effective wellbore milling methods and tools useful in such methods particularly when drilling side or lateral wellbores. There has long been a need for wellbore tools, including but not limited to mills, which provide controlled leakage of a fluid from within the tool, and such tools with apparatus therein for controlling fluid flow therefrom.

SUMMARY OF THE PRESENT INVENTION

The present invention, in one embodiment, discloses a mill with a main body having a central bore therethrough. Different portions of the bore are sized and configured to accommodate different parts of the mill. In one aspect the mill is a starting mill. In another aspect the mill is a window mill or a starting mill/window mill combination.

A top sub is connected to a top end of the main body to facilitate interconnection of the starting mill with a drill string, MWD assembly, jar, stabilizer, or other item. A lower end of the main body has a hole therethrough through which passes a shear stud or bolt for releasably connecting the starting mill to a pilot lug of an upper concave portion of a whipstock. In certain preferred embodiments the lower end of the main body has a series of ratcheting teeth which co-act with corresponding teeth on the pilot lug of the concave so that downward force on the starting mill is transferred to the concave without affecting the shear stud; but an upward force on the starting mill is transferred to the shear stud since the teeth on the starting mill are profiled to slide past the correspondingly profiled teeth on the pilot lug. Thus the shear stud is isolated from downward forces on the starting mill which prevents the shear stud from being sheared, e.g. when a downward force is applied to a whipstock-and-anchor-packer combination to check that the packer is set and to pivot the concave against the casing wall.

A series of cutting blades are secured to (e.g. by welding) or formed integrally of the main body. In one aspect eight blades are used equi-spaced around the circumference of the main body at an enlarged mid-portion thereof. The blades may be dressed with any known matrix and/or milling inserts in any known array, pattern, or combination (e.g., but not limited to the disclosure in pending U.S. application entitled "Wellbore Milling Tools & Inserts" naming Hutchinson as inventor co-owned with the present invention and filed on Sep. 22, 1995 which is incorporated fully herein for all purposes. In one aspect a rectangular array of square tungsten carbide inserts are used on bottoms of the blade(s) and a matrix (e.g., Klustrite™ material; tungsten carbide in a nickel-copper matrix) is used on the side edges and upper portions of the blades. The blades, in one aspect, are inclined slightly inwardly from bottom to top. A top cavity of the central bore of the main body houses apparatus which initially controls fluid flow through the starting mill. A portion of the top cavity is filled with clean fluid (e.g., but not limited to water, drilling fluid, or an ethylene glycol solution). Fluid flows through the starting mill and down through or adjacent an interconnected whipstock via an hydraulic line or tubing to activate a mechanical anchor device or an anchor-packer. Initially the flow of this fluid is directed to the hydraulic line by a labyrinth piston releasably secured by one or more shear pins extending through the labyrinth piston into a shear sub held on a top piston rod. The labyrinth piston blocks off flow through the top cavity of the central bore of the main body. At the other, lower end of the main body an exit port has a male connector which is connected to the hydraulic line, through which clean fluid flows to the anchor (to a setting piston therein in one embodiment) and clean fluid is maintained in the top cavity. During shipment a steel plug is removably disposed in the connector. A retaining plate at the top of the top cavity holds a top end of the top piston rod in place and a lower piston rod plate secured to or formed integrally of the lower end of the top piston rod is secured at a bottom of the top cavity to hold the lower end of the top piston rod in place. A series of fluid flow holes or cut-out flow areas are disposed in the retaining plate and in the lower piston rod plate to permit fluid flow through the plates.

The top cavity has a lower portion with an enlarged inside diameter. As the labyrinth piston is forced down on the top piston rod, it moves relatively sealingly down a constant inside diameter portion of the top cavity and fluid is forced ahead of the labyrinth piston and down and out through the starting mill. Upon entering the lower portion of the top cavity with an enlarged inside diameter, the labyrinth piston no longer blocks substantially all fluid flow through the mill. Sufficient fluid pressure is created and sufficient fluid is forced out from the starting mill and down to the anchor device or anchor-packer to set the anchor device or packer.

With the labyrinth piston disposed in the lower enlarged portion of the top cavity a downward force can be applied through the drill string, through the starting mill and whipstock, to the anchor device or anchor packer to check that the device or packer is properly set. Once anchor setting is verified, downward force is applied to the whipstock through the starting mill to pivot the concave portion against the casing in which the mill-whipstock-anchor system is disposed. Sufficient upward force is then applied to shear the shear stud, freeing the starting mill from the pilot lug on the upper concave portion of the whipstock. Then fluid flow through the starting mill is increased to a level to shear one or more shear pins extending through a shear ring secured in a lower cavity of the mill's central bore and into a lower piston movably disposed in the lower cavity. Shearing of the pin(s) permits the lower piston to move downwardly. Prior to such movement the body of the lower piston blocks fluid flow through one or more flow circulating ports that extend from the central bore to exit points near the bottom of the blades. Upon movement of the lower piston, these flow circulating ports are exposed to fluid flow so that fluid is circulated up past the blades to facilitate the upward removal of debris and milled out cuttings.

It is within the scope of this invention to use a top piston, other than a labyrinth piston, which is disposed sealingly in the top cavity and moves sealingly downwardly. However, a labyrinth piston past which some leakage of fluid is possible is used in certain preferred embodiments in which the starting mill will be used in an environment of relatively high temperature which causes the clean fluid initially disposed in the starting mill to expand. In certain preferred embodiments, e.g. for a chamber of a volume of about forty cubic inches, about three cubic inches may leak out; and for a chamber with a volume of about one hundred cubic inches about nine cubic inches of fluid may leak out. Rather than risk the unwanted and premature setting of an anchor (anchor device or anchor packer) due to expanding fluid, such fluid can leak upwardly past the labyrinth piston. The labyrinth piston acts as a debris barrier to prevent the hydraulic line from being clogged during anchor setting. Air anywhere in the system beneath the labyrinth seal can escape up past the labyrinth so that the hydraulic line and other devices are filled with fluid. Pressure is initially increased sufficiently to overcome the pressure of fluid leaking from the top cavity to set the anchor; and then pressure is increased sufficiently that, even with fluid flowing out from the male connector, the lower shear pins are sheared freeing the lower piston for movement to expose the blade flow ports to fluid flow.

The starting mill, freed from the whipstock, is then rotated and moved downwardly to contact the pilot lug of the concave portion on one side and the casing area to be milled on the other. The milling of the casing proceeds until a desired portion of the casing is milled out. Then the starting mill is removed and a string with a window mill and an optional watermelon mill is inserted to finish the milling operation. Once milling is completed and the milling system is removed from the casing, drilling can commence.

In certain embodiments of the present invention a retrievable whipstock is used. The prior art discloses a variety of retrievable whipstock systems, including (but not limited to) hook-concave slot, threaded member, and toothed engagement retrievable whipstocks. It is within the scope of this invention to use a jar in a string including a retrievable whipstock to facilitate co-action of a retrieval tool with a whipstock by jarring loose debris and/or cuttings which clog devices, holes, threads, etc. and prevent proper co-action of a retrieval tool and whipstock.

In certain embodiments the present invention discloses a whipstock which has an upper solid portion and a lower hollow portion. The lower hollow portion may be empty (initially) or it may be filled with cement, synthetic cement, or other millable material. The two portions may be releasably secured to each other, e.g. with one or more shear pins. The upper portion may have a concave portion or the concave portion may extend to and include part of the lower portion. In one aspect a raised portion on the lower portion is received in and held in a corresponding groove on the upper portion; or these interacting parts can be reversed with the raised portion on the upper portion and the groove on the lower portion. In either case more than one raised portion and groove may be used. In other embodiments a solid whipstock core is releasably housed in an outer hollow member.

The present invention discloses a mill with a longitudinal fluid flow bore therethrough from one top end to a second bottom end with a top piston and a lower piston as described above for controlling fluid flow through the flow bore as described above. The mill may be any mill through which controlled fluid flow is desired. The present invention discloses a wellbore tool with a flow bore therethrough in which semi-perfect sealing of the bore is desired and in which a debris barrier is desired to protect relatively small fluid flow paths, such a tool having a movable labyrinth piston as described above. Such a tool (including but not limited to a mill and/or a whipstock) may employ the structure as described above to activate a shifting sleeve, a movable piston, or other movable part.

In certain embodiments of this invention a whipstock is used which has a flow bore through the whipstock. In other embodiments a flow line is interconnected between a male connector at a lower end of the starting mill and the anchor device or anchor packer below the whipstock.

When an anchor packer is used, an appropriate number and type of shear pins are used to hold the labyrinth piston up. In one aspect, e.g. an anchor packer is to be set at 2000 p.s.i., four shear pins are used which each shear at 875 p.s.i. and fluid at 3500 p.s.i. is circulated to shear the pins and insure setting of the packer.

The present invention discloses, in certain embodiments, a mill for wellbore milling operations having a body with a bore therethrough for fluid flow through the mill, at least one milling surface on the body, and flow control apparatus within the body for selectively controlling fluid flow through the mill; such a mill with an amount of fluid within the bore; such a mill with leakage apparatus for controlled leakage of part of the amount of fluid from the mill; such a mill wherein the leakage apparatus comprises a labyrinth piston movably disposed in the mill body; such a mill wherein the flow control apparatus includes a first flow control device activatable by fluid at a first fluid pressure for permitting fluid at the first pressure to flow from the mill for actuating an item below the mill; such a mill wherein the mill is a starting mill and the item below the mill is an anchor; such a mill wherein the starting mill is releasably connected to a whipstock and the anchor is secured to a lower part of the whipstock; such a mill wherein the flow control apparatus includes a second flow control device activatable at a second fluid pressure and movable in response thereto to permit fluid flow out through at least one port adjacent a milling portion of the mill, the second fluid pressure greater than the first fluid pressure; such a mill with a shearable member releasably connecting the mill to another member, and isolation apparatus on the mill for isolating the shearable member from a downward force on the mill; such a mill with an isolation apparatus comprising ratcheting teeth on the mill body for contacting and engaging corresponding teeth on another member, the teeth disposed and configured so that a downward force on the mill is transferred to the another member through the ratcheting teeth to the corresponding teeth and an upward force on the mill is transferred to the shearable member releasably connecting the mill to the another member; such a mill wherein the another member is a whipstock with an upper concave portion and the shearable member is a shear stud connecting the mill to the concave portion of the whipstock; and such a mill wherein the at least one milling surface is a plurality of milling blades on the mill body.

The present invention also discloses, in certain embodiments, a mill for wellbore milling operations with a body with at least one milling surface thereon, and force isolation apparatus on the body for isolating a shearable member releasably connecting the mill to another member from a downward force on the mill; such a mill wherein the body has a bore therethrough for fluid flow through the mill; such a mill with flow control apparatus within the body for selectively controlling fluid flow through the mill; such a mill with an amount of fluid confined within the bore prior to insertion of the mill into the wellbore, and leakage apparatus for controlled leakage of part of the amount of fluid from the mill; such a mill wherein the flow control apparatus includes a first flow control device in the bore activatable by fluid at a first fluid pressure for permitting fluid at the first pressure to flow from the mill for actuating an item below the mill, and a second flow control device in the bore activatable at a second fluid pressure and movable in response thereto to permit fluid flow out through at least one port adjacent a milling portion of the mill, the second fluid pressure greater than the first fluid pressure; and such a mill with a whipstock, wherein the mill is a starting mill, and the shearable member releasably connecting the mill to the whipstock.

The present invention discloses, in certain embodiments, a method for installing a milling system in a wellbore lined with casing, the milling system having a mill releasably connected to a whipstock and an anchor connected to the whipstock, the mill comprising a body with a bore therethrough for fluid flow through the mill, at least one milling surface on the body, and flow control apparatus within the body for selectively controlling fluid flow through the mill, the flow control apparatus including a first flow control device activatable by fluid at a first fluid pressure for permitting fluid at the first pressure to flow from the mill for actuating the anchor, the method including inserting the milling system into the casing, and flowing fluid at the first fluid pressure through the mill and through the first flow control device to the anchor to set the anchor in the casing; such a method wherein the mill has an amount of fluid confined within the bore prior to insertion of the mill into the wellbore, and leakage apparatus for controlled leakage of part of the amount of fluid from the mill; and such a method wherein a shearable member releasably connecting the mill to the whipstock is isolated from a downward force on the mill but is shearable in response to an appropriate upward force on the mill.

It is, therefore, an object of at least certain preferred embodiments of the present invention to provide:

- New, useful, unique, efficient, non-obvious milling tools, mills, starting mills, window mills, combined starting/window mills, whipstocks, and devices and methods for milling operations;
- Such systems useful in environments of significantly increasing temperature;
- Such starting mills through which anchor setting fluid flows;
- Such starting mills initially containing fluid which is permitted to leak in a controlled manner therefrom upon expansion of the fluid;
- Such systems with such a mill from which air may escape and which prevent debris from clogging the system;
- Such systems in which downward force on a mill is isolated from a shearable device releasably securing the mill to a whipstock
- Such starting mills with selective exposure of fluid flow ports for fluid to flow past blades of the mill;
- Such a system in which an anchor device or anchor packer is used and a whipstock, concave, starting mill, and anchor are run into the hole in one trip which includes orienting of the anchor (and setting of the packer when one is used) hydraulically, pivoting of the concave, and starting mill operation—all in one trip in the hole; and
- Such systems including a jar used with a whipstock retrieval tool.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 2A is a cross-sectional view of the body of FIG. 1A.

FIG. 15A is a side view in cross-section of a whipstock system. FIG. 15B is another side view of the system of FIG. 15A.

DESCRIPTION OF EMBODIMENTS PREFERRED AT THE TIME OF FILING FOR THIS PATENT

Figure 1A:
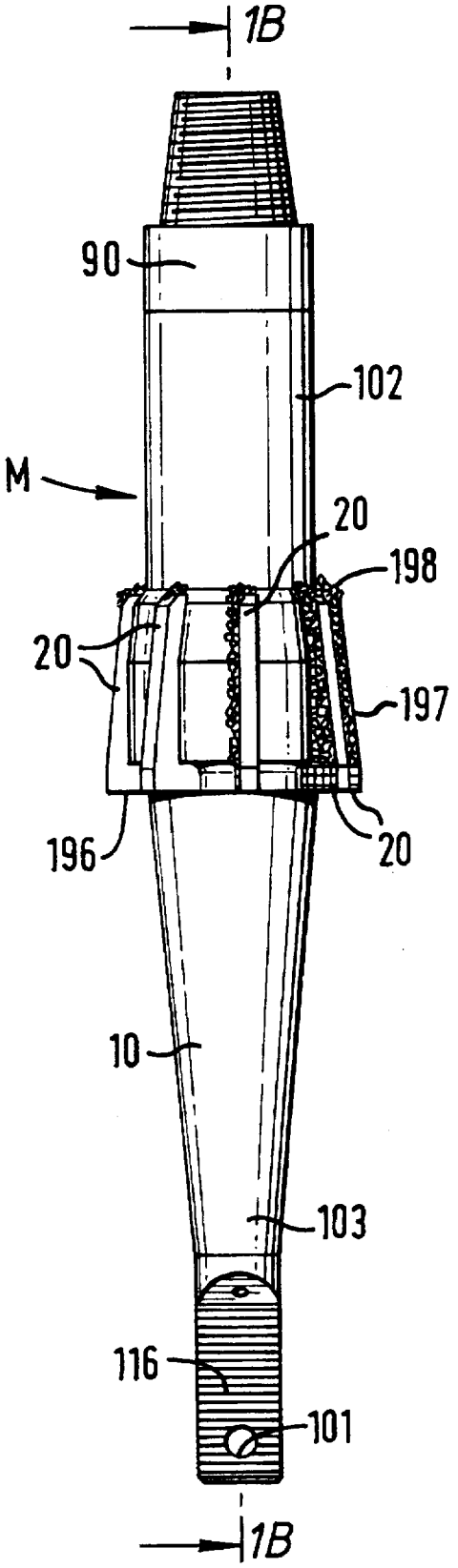
FIG. 1A is a side view of a starting mill according to the present invention.
Figure 1B:
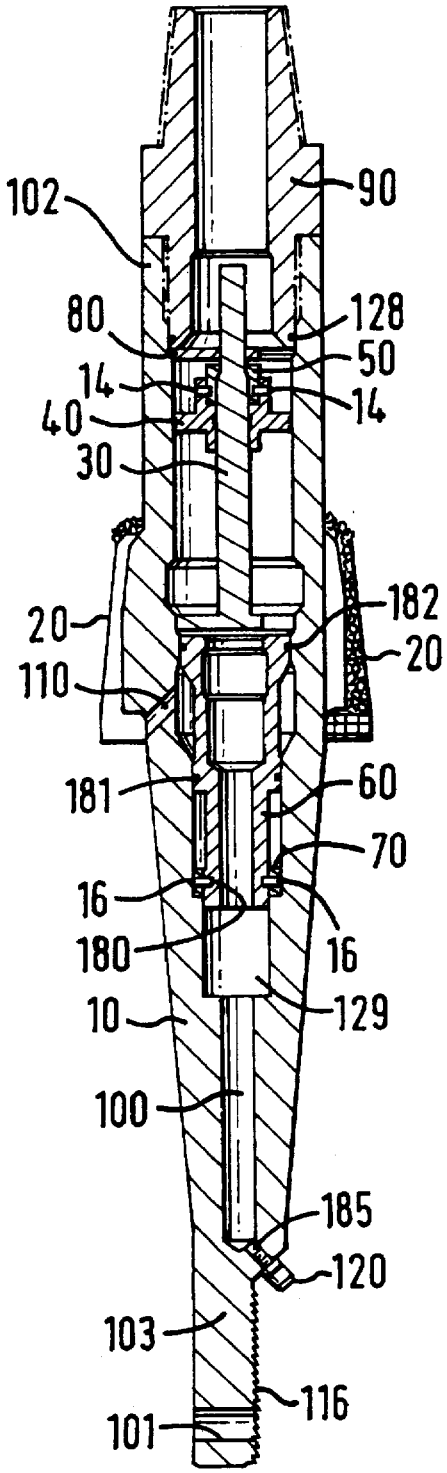
FIG. 1B is across-sectional view of the mill of FIG. 1A.
Figure 1C:
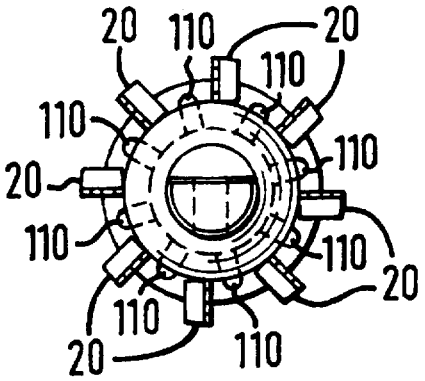
FIG. 1C is an end view of the mill of FIG. 1A.

Referring now to FIGS. 1A–1C, a starting mill M according to the present invention has a body 10 with a central longitudinal (top-to-bottom) fluid flow bore 100 extending therethrough. Typically the mill M is releasably secured to a concave of a whipstock (see FIG. 12). A plurality of milling blades 20 are secured (e.g. by welding) to the exterior of the body 10. Such a mill is useful for milling a hole in casing in a wellbore.

Fluid flowing through the body 10 is selectively controlled by flow control apparatus in the body 10 that includes a lower piston 60 releasably secured in a lower part of the bore 100 and movable therein after release; and a labyrinth piston 40 (and associated apparatus) releasably secured in an upper portion of the bore 100 and movable about a top piston rod 30 upon release. A retaining plate 80 stabilizes a top end 161 (see FIG. 7A) of the top piston rod 30. A top sub 90 is releasably secured to a top end 102 of the body 10.

The labyrinth piston 40 is initially secured in place by shear pins 14 that extend through holes 153 in the labyrinth piston into recesses 143 in a shear sub 50 (see FIG. 5A) which is affixed about the top piston rod 30. Shearing of the pins 14 in response to fluid pumped into the wellbore at a first fluid pressure releases the labyrinth piston 40 for movement in the bore 100 and effects breaking of a plug 187 in a lower male connector 120 so that fluid flows through an hydraulic line to set an anchor (not shown) below the whipstock.

Figure 8A:
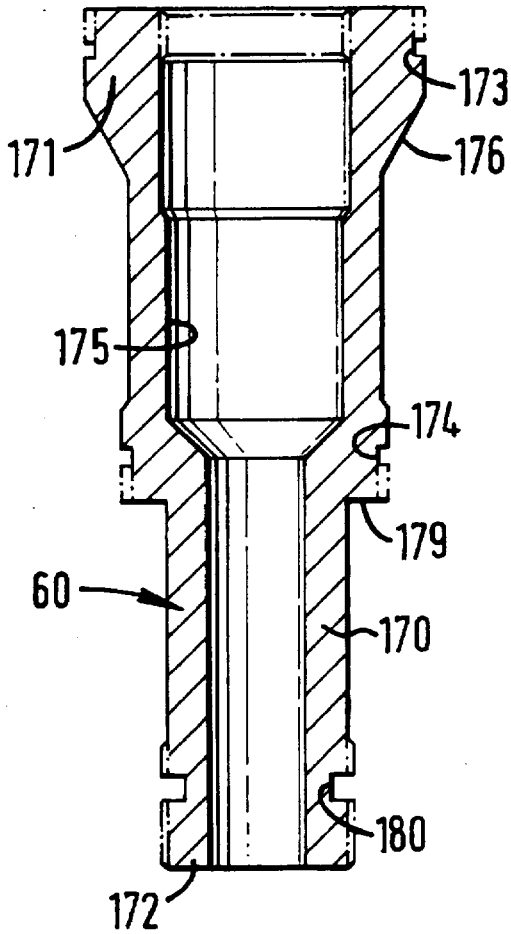
FIG. 8A is a side cross-sectional view along line 8A—8A of FIG. 1B of a lower piston of the mill of FIG. 1A.

The lower piston 60 is initially secured in place by shear pins 16 extending from holes 193 (see FIG. 9A) in a shear ring 70 in the bore 100 into recesses 180 in a bottom end 172 of the lower piston 60 (see FIG. 8A). Shearing of the pins 16 in response to fluid at a second fluid pressure (greater than the first fluid pressure) releases the lower piston 60 for movement in the bore 100 so that fluid flow ports 110 adjacent the blades 20 are exposed to fluid flow.

A cavity extending from a lower exit port 185 to the labyrinth piston 40 is initially filled with a clean fluid (e.g., but not limited to, water, drilling fluid, ethylene glycol solution, or a combination thereof) which is held in place by the labyrinth piston 40 at the top and, during shipment, by a plug (not shown) removably positioned in a male connector 120 provided at the exterior of a lower exit port 185 to which an hydraulic line or other item may be connected. Below the cavity the hydraulic line and packer or other anchor are filled with fluid so fluid is maintained in the cavity.

Eight blades 20 are shown, but any desired number (one, two, three, four, etc.) may be used. Each blade 20 has three primary milling surfaces: a lower part 196; a mid-portion 197; and a top part 198. It is within the scope of this invention for any or all of these parts to be dressed with any known milling inserts, matrix material, or combination thereof in any known disposition, configuration, array, or pattern. Fluid under pressure to facilitate evacuation of debris and cuttings away from the blades 20 flows out from the bore 100 through fluid flow ports 110 which, preferably, exit the body 10 near the lower parts 196 of the blades 20.

Figure 2C:
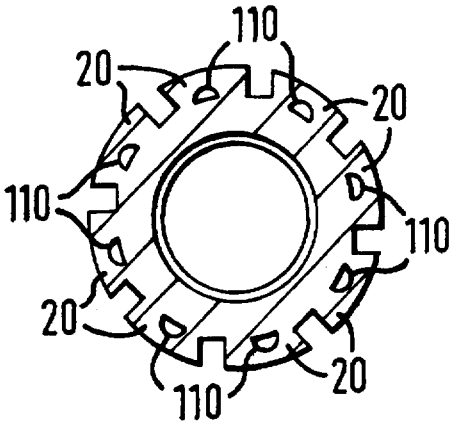
FIG. 2C is a cross-sectional view along line 2C—2C of FIG. 2B.
Figure 2A:
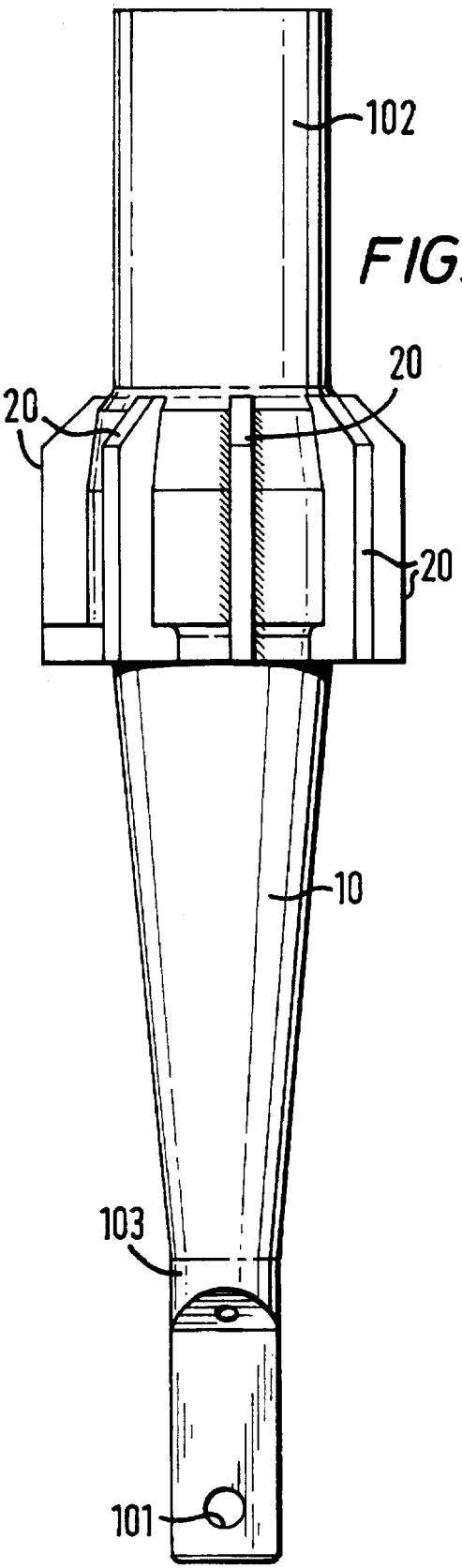
FIGS. 2A is a side view of the main body of the starting mill of FIG. 1A.
Figure 2B:
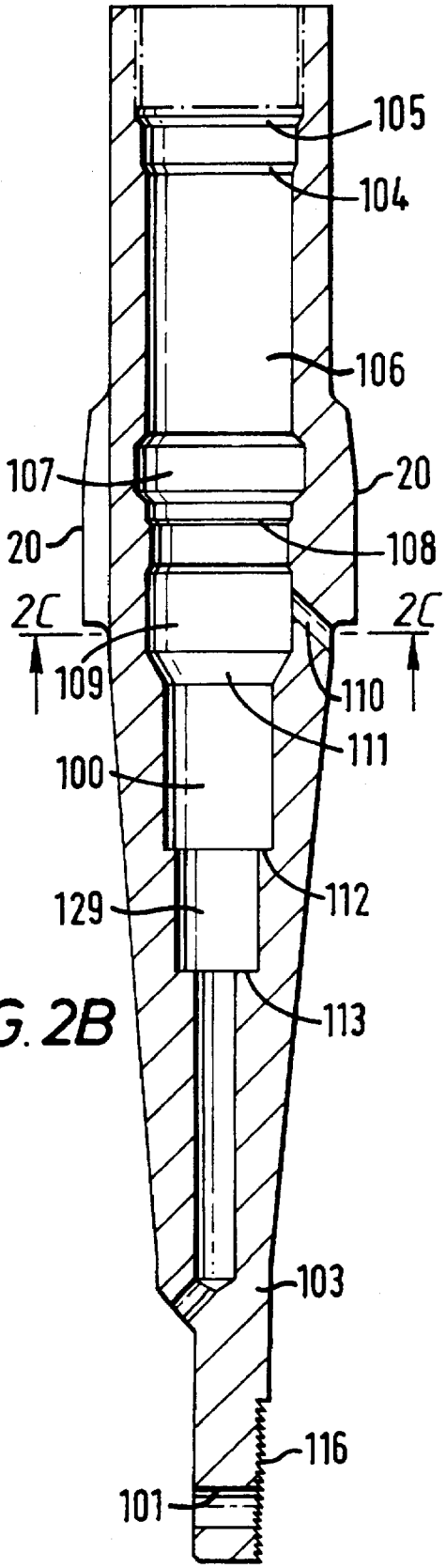

FIGS. 2A–2C illustrate the body 10 and its bore 100. The body 10 has a top shoulder 105; an upper shoulder 104; a top cavity 106; an enlarged cavity 107; a plate shoulder 108; a mid-cavity 109; fluid flow ports 110; a lower piston shoulder 111; a lower shoulder 112; and a bottom shoulder 113.

Ratchet (or "wicker") teeth 116 are provided on a side of the lower end 103 of the body 10. The teeth 116 are profiled so that upon pushing down on the body 10 the teeth contact and engage teeth on a whipstock and downward force is transmitted to the whipstock while the downward force is isolated from a shear stud (not shown) extending through a hole 101 in the body 10 into a pilot lug of the whipstock (not shown). The teeth 116 are also profiled so that in response to an upward pull on the body 10 there is no engagement with the corresponding teeth on the pilot lug, the shear stud is not isolated from the force of such upward pulling, and the shear stud is shearable when enough upward force is applied, e.g. twenty thousand to thirty thousand pounds.

Figure 3A:
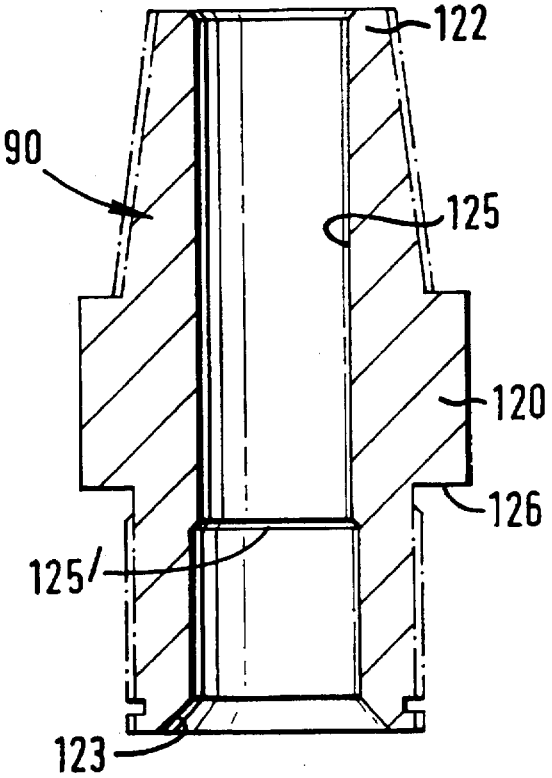
FIG. 3A is a side cross-sectional view of a top sub of the mill of FIG. 1A along line 3A—3A of FIG. 3B.
Figure 3B:
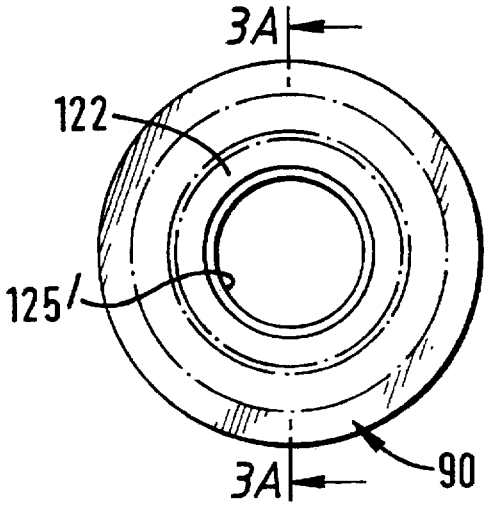
FIG. 3B is a top view of the top sub of FIG. 3A.

FIGS. 3A and 3B show the top sub 90 which has a top end 122, a lower shoulder 123, and upper shoulder 125, and a mid-portion 120. A lower shoulder 126 abuts the top end 102 of the body 10 of the mill M. A portion of the top piston rod 30 extends into a fluid flow bore 125 of the top sub 90.

Figure 4B:
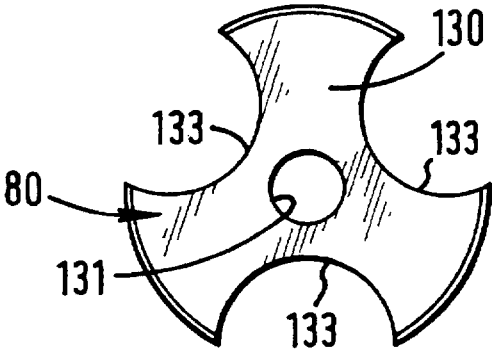
FIG. 4B is a top view of the plate of FIG. 4A
Figure 4A:
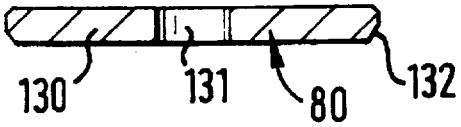
FIG. 4A is a side cross-sectional view of a retaining plate of the mill of FIG. 1A.

FIGS. 4A and 4B show the retaining plate 80 with a body 130 and a lower shoulder 132 (which rests against the upper shoulder 104 of the body 10, FIG. 1B) which has a hole 131 through which extends the top piston rod 30. Fluid flows through flow areas defined by arced portions 133 of the plate 80.

Figure 5A:
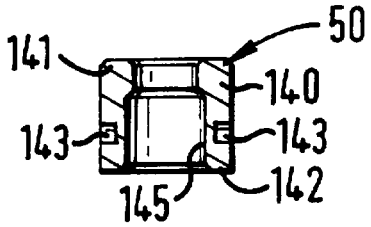
FIG. 5A is a side cross-sectional view of a shear sub of the mill of FIG. 1A along line 5A—5A of FIG. 5B.
Figure 5B:
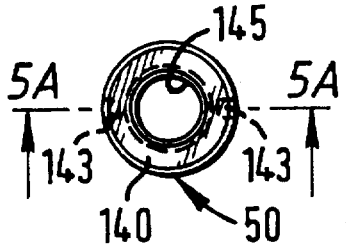
FIG. 5B is a top view of the shear sub of FIG. 5A.

FIGS. 5A and 5B illustrate the shear sub 50 which has a body 140 with a top end 141, bottom end 142 and shear pin recesses 143. A fluid flow bore 145 extends through the body 140. A top shoulder 144 rests on a shoulder 164 of the top piston rod 30 (see FIG. 1B) to hold the shear sub 50 in place about the top piston rod 30.

Figure 6A:
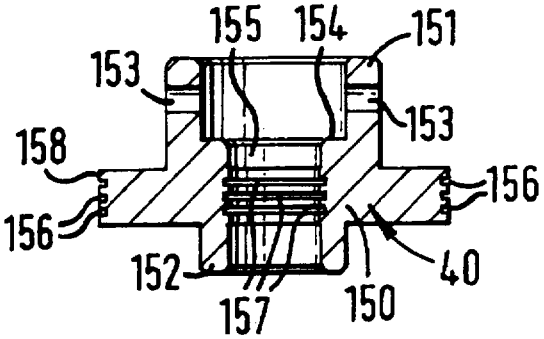
FIG. 6A is a side cross-sectional view of a labyrinth piston of the mill of FIG. 1A long the line 6A—6A of FIG. 6B.
Figure 6B:
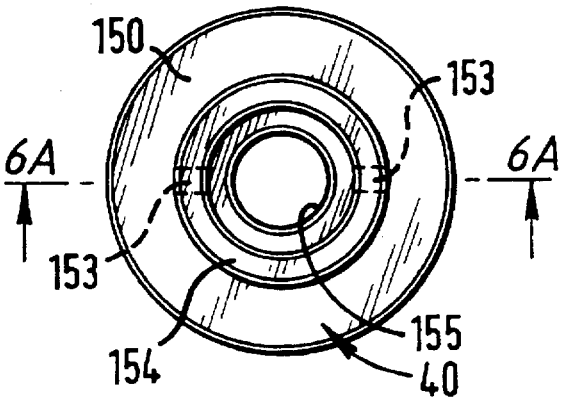
FIG. 6B is a top view of the piston of FIG. 6A.

FIGS. 6A and 6B show the labyrinth piston 40 which has a body 150, a top end 151, a bottom end 152, an inner shoulder 154, and a fluid flow bore 155 through the body 150. Controlled leakage around the labyrinth piston 40 is provided by one or more exterior labyrinth grooves 156 and interior labyrinth grooves 157. Shear pins 14 (FIG. 1B) extend into shear pin recesses 143 (FIG. 5A). An exterior surface 158 of the labyrinth piston 40 contacts an interior surface of the body 10 (see FIG. 1B) to confine clean fluid in the top cavity 106 of the body 10.

Figure 7A:
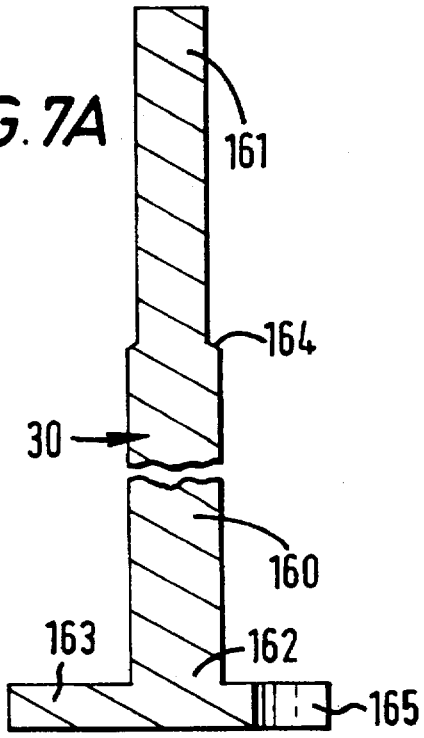
FIG. 7A is a side cross-sectional view of a top piston rod of the mill of FIG. 1A along line 7A—7A of FIG. 7B.
Figure 7B:
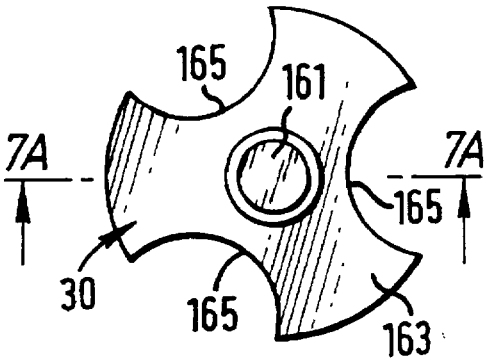
FIG. 7B is a top view of the rod of FIG. 7A.

FIGS. 7A and 7B show the top piston rod 30 which has a body 160 with a top end 161, a shoulder 164, a bottom end 162 and a piston rod plate 163. The piston rod plate 163 rests against the plate shoulder 108 (see FIG. 1B) of the bore 100 of the body 10. Fluid flows past the piston rod plate 163 through flow areas defined by arced portions 165 of the plate 163.

Figure 8B:
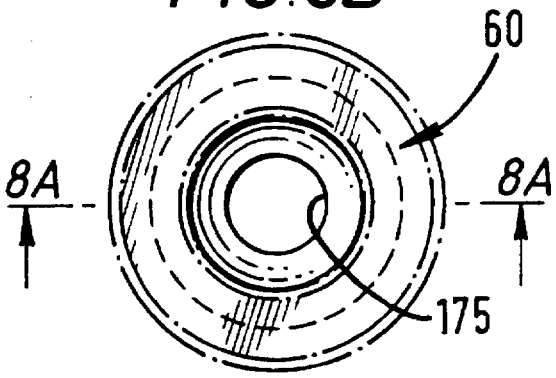
FIG. 8B is a top view of the piston of FIG. 8A.

FIGS. 8A and 8B show the lower piston 60 which has a body 170 with a top end 171, a bottom end 172 and a fluid flow bore 175 through the body 170. An 0-ring 182 (FIG. 1B) is positioned in a groove 173 and an 0-ring 181 (FIG. 1B) is positioned in a groove 174 (see FIG. 1B). Shear pins 16 (FIG. 1B) extend into shear pin recesses 180. A shoulder 176 moves to abut the lower piston shoulder 111 of the bore 100 of the body 10 and a shoulder 179 moves so that the shear ring 70 abuts the lower shoulder 112 of the bore 100 of the body 10 (FIG. 2B) to prevent further downward movement of the lower piston 60 as the bottom end 172 is received in a bottom portion 129 (see FIG. 1B) of the bore 100.

Figure 9A:
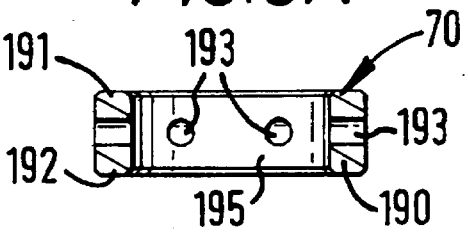
FIG. 9A is a side cross-sectional view of shear ring of the mill of FIG. 1A along line 9A—9A of FIG. 9B.
Figure 9B:
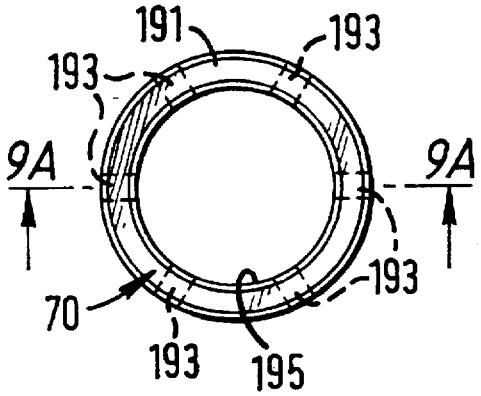
FIG. 9B is a top view of the shear ring of FIG. 9A.

FIGS. 9A and 9B show the shear ring 70 which has a body 190 with a top end 191, a bottom end 192 and a fluid flow bore 195 through the body 190. Holes 193 receive the shear pins 16 (FIG. 1B) to initially prevent movement of the lower piston 60.

Figure 10:
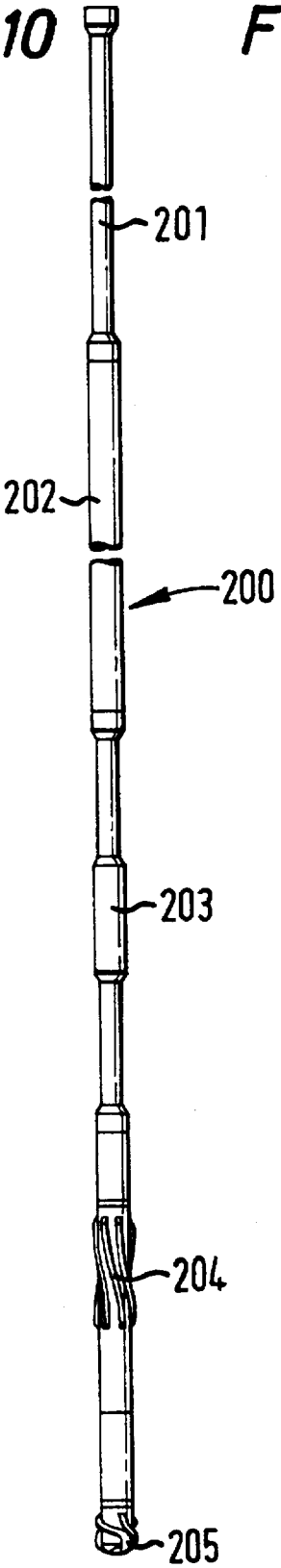
FIG. 10 is a side view of a milling system useful in operations according to the present invention.

FIG. 10 illustrates a milling system 200 with pieces of drill pipe 201 threadedly connected to drill collars 202 and heavy pipe 203. A watermelon mill 204 is threadedly connected to the heavy pipe 203 and a window mill 205 is threadedly connected to the watermelon mill 204.

Figure 11:
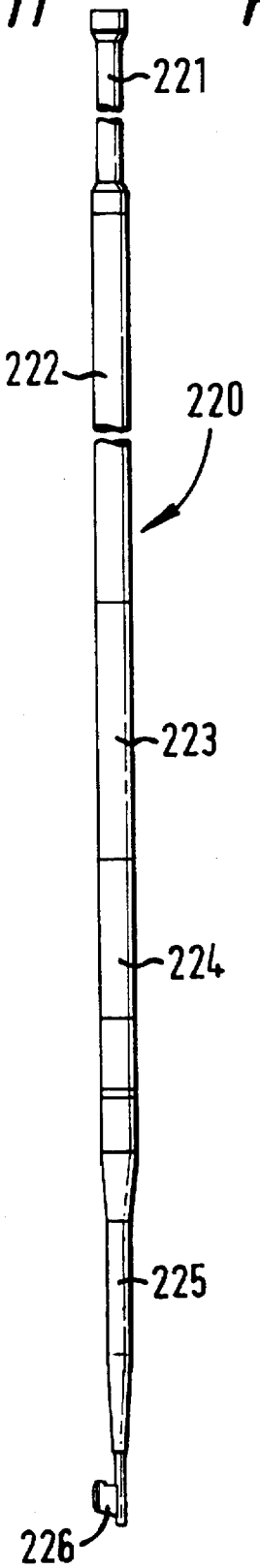
FIG. 11 is a side view of a retrieval tool system according to the present invention.

FIG. 11 discloses a retrieval system 220 according to the present invention which has drill pipes 221 threadedly connected to drill collars 222. An orientation indicating device 223 (e.g. a measuring-while-drilling device or a gyroscopic tool) is interconnected between the drill collars and a jarring device 224 (any conventional commercially available jar). A retrieval tool 225 with a hook 226 for insertion into a corresponding hole in a whipstock is connected to the jar 224. Such a tool is shown in U.S. Pat. No. 5,341,873 issued on Aug. 30, 1994 entitled "Method And Apparatus For Deviated Drilling" which is co-owned with the present invention and incorporated fully herein for all purposes.

Figure 12:
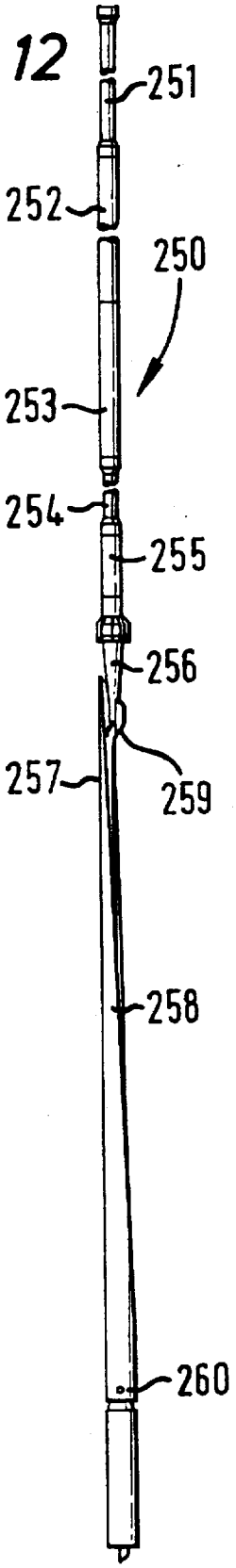
FIG. 12 is a side view of a milling system according to the present invention.

FIG. 12 shows a system 250 according to the present invention which has drill pipes 251, drill collars 252, an orientation sensor device 253, drill pipe 254, a cross-over sub 255, a starting mill 256 (like the mill M previously described), a whipstock 258 with a concave with a concave surface 257, an hydraulic fluid line 259 intercommunicating between the starting mill 256 and an hydraulically activated anchor (anchor device or anchor packer) at a pivot device 260 (pivot device as is well known in the art).

Figure 13A:
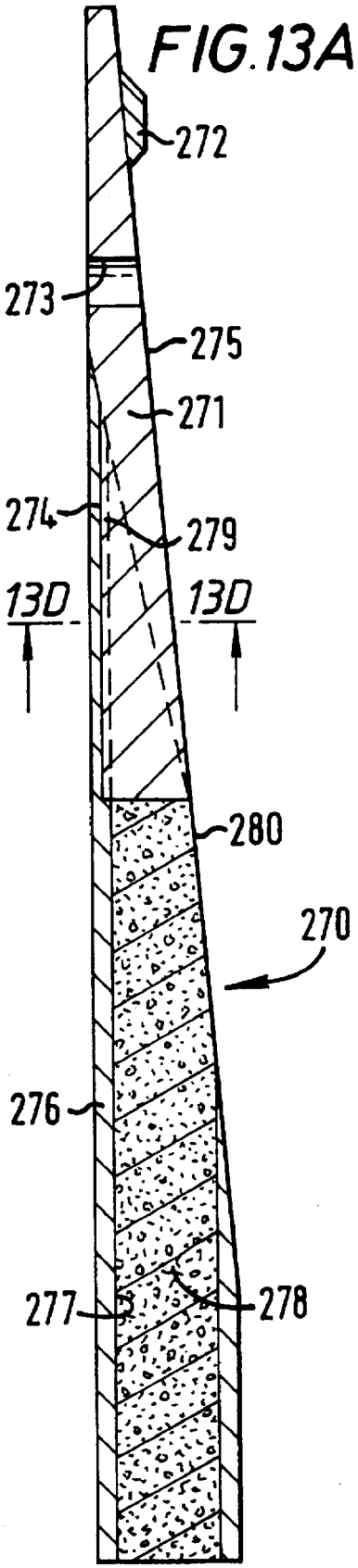
FIG. 13A is a side cross-sectional view of a whipstock according to the present invention.
Figure 13B:
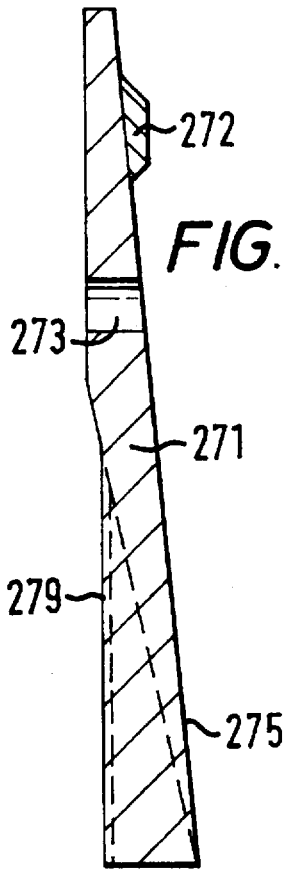
FIG. 13B is a side cross-sectional view of a top portion of the whipstock of FIG. 13B.
Figure 13C:
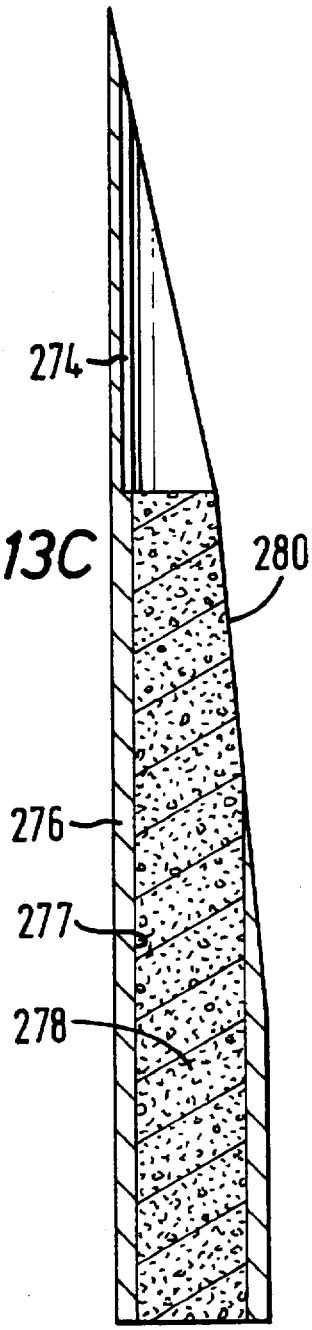
FIG. 13C is a side cross-sectional view of a lower portion of the whipstock of FIG. 13A.
Figure 13D:
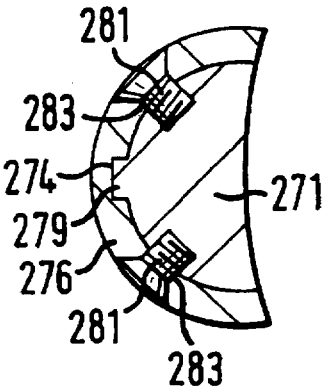
FIG. 13D is a cross-sectional view alone line 13D—13D of FIG. 13A.

FIG. 13A–13D shows a whipstock 270 according to the present invention which has a top solid part 271 releasably connected to a hollow lower part 276. The top solid part 271 has a pilot lug 272, a retrieval hook hole 273, a concave inclined surface 275 and a rail 279. The lower hollow part 276 has an inner bore 277 shown filled with drillable filler material or cement 278. The cement is in the tool as it is inserted into the casing. The lower hollow part 276 has a concave inclined surface 280 which lines up with the concave inclined surface 275 of the top solid part 271. As shown in FIG. 13D shear screws 281 extend through holes 283 in the lower hollow part 276 and holes 282 in the top solid part 271 to releasably hold the two parts together. The rail 279 is received in a corresponding groove 274 in the lower hollow part 276 to insure correct combination of the two parts. Preferably the length of the top solid part is at least 50% of the length of the inclined portion of the concave. A whipstock 270 maybe used in the system 250 (FIG. 12) or any other system disclosed herein. Upon completion of an operation, the top solid part is released by shearing the shear screws with an upward pull on the whipstock, making retrieval and re-use of the top solid part possible. The bottom hollow part need never leave the wellbore.

Figure 14A:
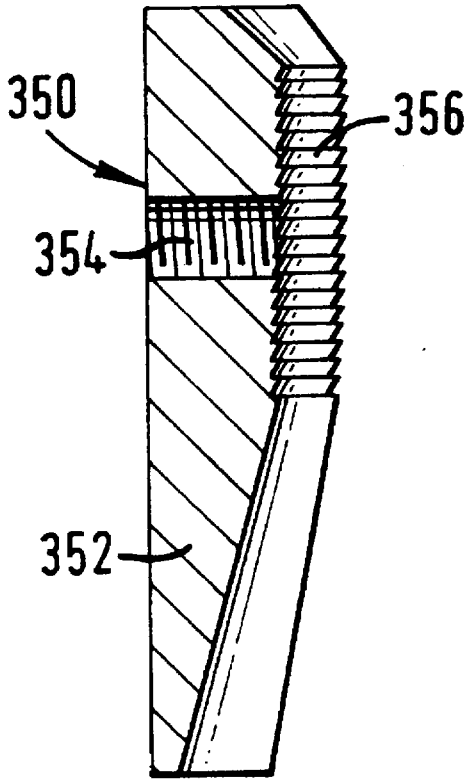
FIG. 14A is a perspective view of a pilot-lug of a whipstock according to the present invention.
Figure 14B:
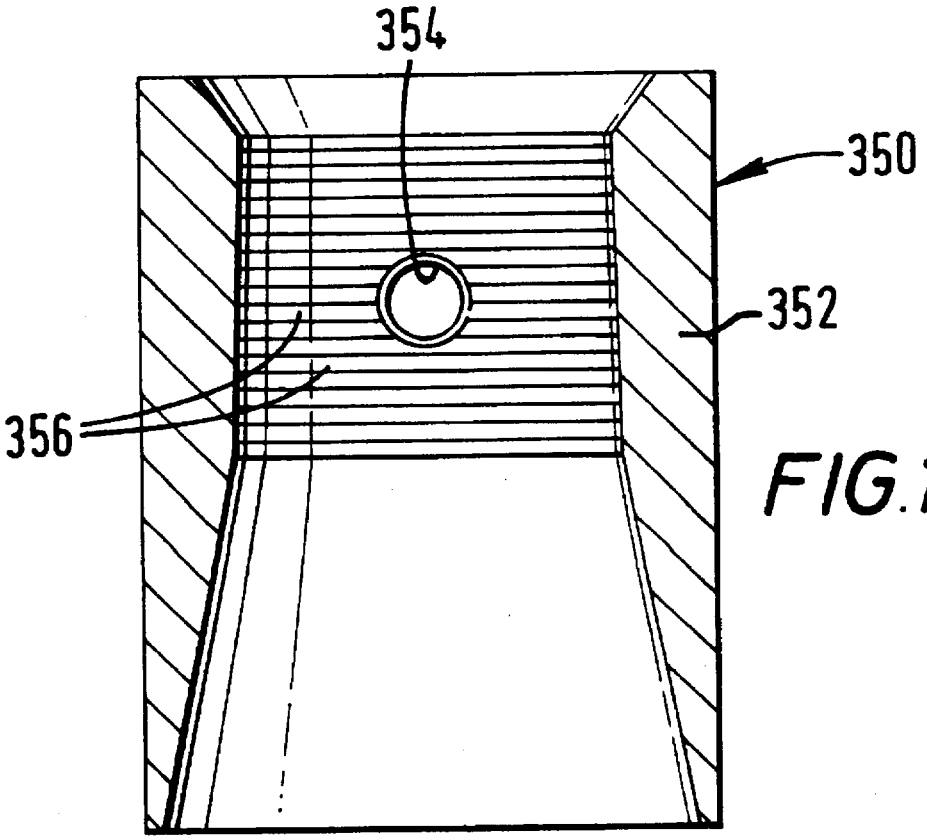
FIG. 14B is a front view of the pilot lug of FIG. 14A.

FIGS. 14A and 14B show a pilot lug 350 according to the present invention with a body 352 having a hole 354 therethrough through which a shear stud or bolt (not shown) extends to releasably secure another item (e.g. a mill) to the pilot lug. Ratchet or wicker teeth 356 on the pilot lug 350 co-act with corresponding teeth on another member (e.g. teeth 116, FIG. 1B) and operate, as described above, to isolate the shear stud from a downward force applied to a member (e.g. the mill of FIG. 1B) releasably secured by the shear stud to the pilot lug 350. The lug 272 (FIG. 13B) may have the teeth 356, as may any other pilot lug or member for attaching a mill to a whipstock.

FIGS. 15A and 15B illustrate a whipstock 300 according to the present invention in a casing C in a wellbore. The whipstock 300 has an outer hollow tubular member 302 having a top end 303, a bottom end 304 and a central bore 305; and an inner solid member 306 with a top end 307, a bottom end 308, a concave 309 with a concave inclined surface 310, and a retrieval hook slot 311 in the concave 309. The hollow tubular member 302 is secured to the casing and, while in use, the inner solid member 306 is releasably secured to the outer hollow tubular member 302, e.g. by shear pins 312 extending from the inner solid member 306 into the outer hollow tubular member 302. As shown in FIG. 15B, upon shearing of the pins 312 by an upward pull with a retrieval tool T, the retrieval tool T is used to remove the inner solid member 306 for re-use.

In one method according to the present invention, at the surface a shear ring 70 is secured with shear pins 16 to the lower piston 60, the number of shear pins depending on the pressure at which the anchor is to be set. Such shear pins are made from, e.g., low carbon steel or brass; and the major parts of the mill are made from steel or alloy steel, e.g. 4140 steel. A male connector 120 is connected to a bottom of the mill body 10 and the mill body 10 is filled with clean fluid. The shear sub 50 is installed in and pinned to the labyrinth piston 40 and then the shear-sub-labyrinth-piston combination is slid onto the top piston rod 30. The weight of this combination may result in the displacement of fluid from within the body 10 across and out from above the labyrinth piston. The retaining plate 80 is then installed on the top piston rod 30. A releasable retaining cap (made from e.g. plastic or aluminum) is placed over the mill body 10 for shipment and movement. The retaining cap is removed at a rig site. The mill M is then secured to a whipstock with a shear stud passing through the hole 101 and into a pilot lug of the whipstock. The whole assembly is then introduced on a drill string into a cased wellbore filled with drilling fluid. If increased temperature is encountered as the assembly moves down in the drilling fluid, clean fluid leakage past the labyrinth piston increases to accommodate expanding clean fluid so that the anchor is not prematurely set. By increasing the pressure of fluid pumped by surface pumps down into the mill M, the leakage past the labyrinth piston is overcome and pressure is increased sufficiently to shear the shear pins 14, freeing the labyrinth piston to move and push fluid so that fluid flows out from the mill M to set the anchor. Packer setting is verified by additional dropping of the drill string and then enough downward force is applied to the whipstock through the mill M (while, preferably, isolating the shear stud from such force) to effect pivoting of the concave of the whipstock against the casing wall. Then the drill string is pulled upwardly to shear the shear stud and break the hydraulic line from the mill M to free the mill M from the whipstock. The hydraulic line connects the mill M to the anchor or to a line or bore through the whipstock to the anchor. Pumps on the surface then pump fluid down through the mill M at a pressure sufficiently high to overcome flow out through the lower exit port 185 and to shear the shear pins 16 freeing the lower piston 60 for downward movement to expose the blade flow ports 110 to fluid. Fluid is then pumped out past and upwardly away from the blades 20 as the string is rotated to mill the casing. Once the casing has been initially milled, an additional milling system (e.g. with a watermelon mill and a window mill) may be inserted in another trip into the wellbore to accomplish additional milling. Upon removal of the additional system from the wellbore a drilling system is introduced into the wellbore to commence drilling a new borehole through the window that has been milled in the casing.

What is claimed is:

1. A mill for wellbore milling operations, the mill comprising a body with at least one milling surface thereon, and force isolation apparatus on the body for isolating a shearable member releasably connecting the mill to another member from a downward force on the mill.

2. The mill of claim 1 further comprising the body with a bore therethrough for fluid flow through the mill.

3. The mill of claim 2 further comprising flow control apparatus within the body for selectively controlling fluid flow through the mill.

4. The mill of claim 3 wherein the flow control apparatus includes a first flow control device in the bore activatable by fluid at a first fluid pressure for permitting fluid at the first pressure to flow from the mill for actuating an item below the mill, and a second flow control device in the bore activatable at a second fluid pressure and movable in response thereto to permit fluid flow out through at least one port adjacent a milling portion of the mill, the second fluid pressure greater than the first fluid pressure.

5. The mill of claim 2 further comprising an amount of fluid confined within the bore prior to insertion of the mill into the wellbore, and leakage apparatus in the bore for controlled leakage of part of the amount of fluid past the leakage apparatus from the first part of the bore into a second part of the bore.

6. The mill of claim 1 further comprising a whipstock, wherein the mill is a starting mill, and the shearable member releasably connecting the mill to the whipstock.

7. A method for installing a milling system in a wellbore lined with casing, the milling system having a mill releasably connected to a whipstock and an anchor connected to the whipstock, the mill comprising a body with a bore therethrough for fluid flow through the mill, at least one milling surface on the body, and flow control apparatus within the body for selectively controlling fluid flow through the mill, the flow control apparatus including a first flow control device activatable by fluid at a first fluid pressure for permitting fluid at the first pressure to flow from the mill for actuating the anchor, the method comprising inserting the milling system into the casing, and flowing fluid at the first fluid pressure through the mill and through the first flow control device to the anchor to set the anchor in the casing.

8. The method of claim 7 wherein the mill further comprises an amount of fluid confined within a first part of the bore prior to insertion of the mill into the wellbore, and leakage apparatus in the bore for controlled leakage of part of the amount of fluid past the leakage apparatus from the first part of the bore into a second part of the bore.

9. A mill for wellbore milling operations, the mill comprising a body with a bore therethrough for fluid flow through the mill, at least one milling surface on the body, flow control apparatus within the body for selectively controlling fluid flow through the mill, and an amount of clean fluid within the bore.

10. The mill of claim 9 wherein the amount of clean fluid is in a first part of the bore and the mill further comprising leakage apparatus in the bore for controlled leakage of part of the amount of clean fluid past the leakage apparatus from the first part of the bore into a second part of the bore.

11. The mill of claim 10 wherein the leakage apparatus comprises a labyrinth piston movably disposed in the bore of the mill body.

12. The mill of claim 9 wherein the flow control apparatus includes a first flow control device activatable by fluid at a first fluid pressure for permitting fluid at the first pressure to actuate an item below the mill.

13. The mill of claim 9 further comprising the at least one milling surface comprising a plurality of milling blades on the mill body.

14. A starting mill for wellbore milling operations, the starting mill comprising a body with a bore therethrough for fluid flow through the starting mill, at least one milling surface on the body, flow control apparatus within the body for selectively controlling fluid flow through the starting mill, the flow control apparatus including a first flow control device activatable by fluid at a first fluid pressure for permitting fluid at the first pressure to actuate an anchor below the starting mill.

15. The mill of claim 14 wherein the starting mill is releasably connected to a whipstock and the anchor is secured to a lower part of the whipstock.

16. The mill of claim 14 wherein the flow control apparatus includes a second flow control device activatable at a second fluid pressure and movable in response thereto to permit fluid flow out through at least one port adjacent a milling portion of the mill, the second fluid pressure greater than the first fluid pressure.

17. A mill for wellbore milling operations, the mill comprising a body with a bore therethrough for fluid flow through the mill, at least one milling surface on the body, flow control apparatus within the body for selectively controlling fluid flow through the mill, a shearable member releasably connecting the mill to another member, and isolation apparatus on the mill for isolating the shearable member from a downward force on the mill.

18. The mill of claim 17 further comprising the isolation apparatus comprising profiled teeth on the mill body for contacting and engaging corresponding teeth on another member, the profiled teeth disposed and configured so that a downward force on the mill is transferred to the another member through the profiled teeth to the corresponding teeth and an upward force on the mill is transferred to the shearable member releasably connecting the mill to the another member.

19. The mill of claim 17 wherein the another member is a whipstock with an upper concave portion and the shearable member is a shear stud connecting the mill to the concave portion of the whipstock.

* * * * *